US005292263A

United States Patent [19]

Mosser et al.

[11] Patent Number: 5,292,263

[45] Date of Patent: Mar. 8, 1994

[54] ELECTRICAL CONNECTOR

[75] Inventors: III Mosser, Middletown; Robert H. Frantz, Newville, both of Pa.

[73] Assignee: The Whitaker Corporation, Wilmington, Del.

[21] Appl. No.: 3,159

[22] Filed: Jan. 12, 1993

[51] Int. Cl.[5] ..... H01R 4/38

[52] U.S. Cl. ..... 439/812

[58] Field of Search ..... 439/709, 810–814

[56] References Cited

U.S. PATENT DOCUMENTS

| | | | |
|---|---|---|---|
| 3,464,055 | 8/1969 | Lescarboura | 439/733 |
| 3,803,534 | 4/1974 | Debaight | 439/807 |
| 4,006,323 | 2/1977 | Nelson et al. | 200/284 |
| 4,070,086 | 1/1978 | Trafford | 439/717 |
| 4,162,819 | 7/1979 | Eisert | 439/711 |
| 4,171,152 | 10/1979 | Geiseler | 439/752 |
| 4,331,377 | 5/1982 | Ebbinghaus et al. | 439/733 |
| 4,340,270 | 7/1982 | Wilmes et al. | 439/397 |
| 4,669,806 | 6/1987 | Fuchs | 439/712 |
| 4,693,542 | 9/1987 | Heng et al. | 439/626 |
| 4,810,212 | 3/1989 | Norden | 439/709 |
| 4,929,198 | 5/1990 | Strate et al. | 439/709 |

FOREIGN PATENT DOCUMENTS

| | | | |
|---|---|---|---|
| 517945 | 10/1955 | Canada | 439/814 |
| 1087201 | 8/1960 | Fed. Rep. of Germany | 439/812 |
| 2201736 | 7/1973 | Fed. Rep. of Germany . | |
| 2520561 | 12/1985 | France . | |

*Primary Examiner*—Gary F. Paumen

[57] ABSTRACT

An electrical connector includes a cage which defines a wire receiving area aligned with a wire insertion axis, an elongated slot oriented obliquely with respect to the wire insertion axis, a clamp guided by the slot for movement toward and away from the wire receiving area, and a clamp screw rotatably mounted in the cage to move the clamp toward and away from the wire receiving area. The cage includes side walls and top walls, and the top walls are mechanically interlocked to resist separation. The clamp defines elongated ribs that engage the elongated slots, and the elongated ribs are configured to resist rotation of the clamp in the cage. The clamp is configured such that a portion of the clamp cantilevers beyond the free end of the screw when the screw is rotated to bring the clamp closely adjacent the contact surface. The screw is held in place in the cage by transverse slots defined by wings of the cage. These transverse slots intersect the elongated guide slots that receive the ribs of the clamp.

9 Claims, 6 Drawing Sheets

ELECTRICAL CONNECTOR

BACKGROUND OF THE INVENTION

This invention relates to an electrical connector of the type which utilizes a clamp screw to move a clamp inside a cage in order to force the clamp toward a contact surface defined by the cage to terminate a wire.

French Patent Document 2 520 561 describes one electrical connector of the general type set out above. In this connector a sheet metal cage defines a pair of parallel guide slots which receive circular bosses formed on a clamp. The clamp defines a threaded bore that receives a screw, and this screw is captured in the sheet metal cage such that it is free to rotate but is restrained from axially outward movement. The cage defines a wire receiving area and a contact surface on an inside wall of the cage opposite the clamp. By rotating the screw the clamp can be moved away from the contact surface in order to allow a wire to be inserted into the wire receiving area. The screw can then be rotated to urge the clamp against the wire, thereby immobilizing the wire between the clamp and the contact surface.

The present invention is directed to improvements to electrical connectors of the type described initially above, which strengthen the cage against distortion, simplify assembly, and reduce the tendency of the clamp to shift or rotate undesirably when subjected to an eccentric load.

SUMMARY OF THE INVENTION

As pointed out above, this invention relates to improvements to an electrical connector of the type comprising a cage which defines a wire receiving area aligned with a wire insertion axis, and a first guide element; a clamp guided by the first guide element for movement toward and away from the wire receiving area; and a clamp screw rotatably mounted in the cage to move the clamp toward and away from the wire receiving area.

According to a first aspect of this invention, an electrical connector of the type described above is provided with first and second side walls included in the cage, each of the side walls joined at a respective edge to a respective top wall, said top walls being substantially coplanar and situated adjacent one another. One of the top walls defines a protruding element oriented to face the other top wall, and the other top wall defines a recess shaped and positioned to receive the protruding element. The recess and the protruding element form a mechanical interlock to resist separation of the top walls.

The protruding element and recess cooperate to form a means for resisting separation of the top walls. In other forms of the invention this means can take other forms, such as a spot weld or the like.

According to a second aspect of this invention, an electrical connector of the type described above is provided with at least one second guide element on the clamp positioned to engage the first guide element. The second guide element has a length along the axis of the first guide element and a width transverse to this axis. The length is greater than the width such that the first and second guide elements resist rotation of the clamp within the cage. Because rotation of the clamp element in the cage is resisted, the clamp element is more positively positioned as desired within the cage.

According to a third aspect of this invention, an electrical connector of the type described above includes a contact surface in the wire receiving area opposite the clamp, and a free end of the screw spaced from the contact surface. The clamp defines a threaded bore that receives the screw, and the clamp is configured such that a portion of the clamp cantilevers beyond the free end of the screw when the screw is rotated to bring the clamp closely adjacent to the contact surface. With this arrangement the free end of the screw can be positioned such that it does not interfere with complete insertion of the wire into the wire receiving area.

According to a fourth aspect of this invention, an electrical connector of the type described above is provided with a pair of upstanding wings defined by the cage. Each of the wings defines a respective transverse slot. The screw comprises a screw head which defines an annular flange received by the transverse slots such that the screw is captured in the cage against movement out of the cage but is free to rotate in the cage. In the preferred form described below, this arrangement facilitates assembly of the electrical connector.

DETAILED DESCRIPTION OF THE PRESENTLY PREFERRED EMBODIMENTS

Figure 1:
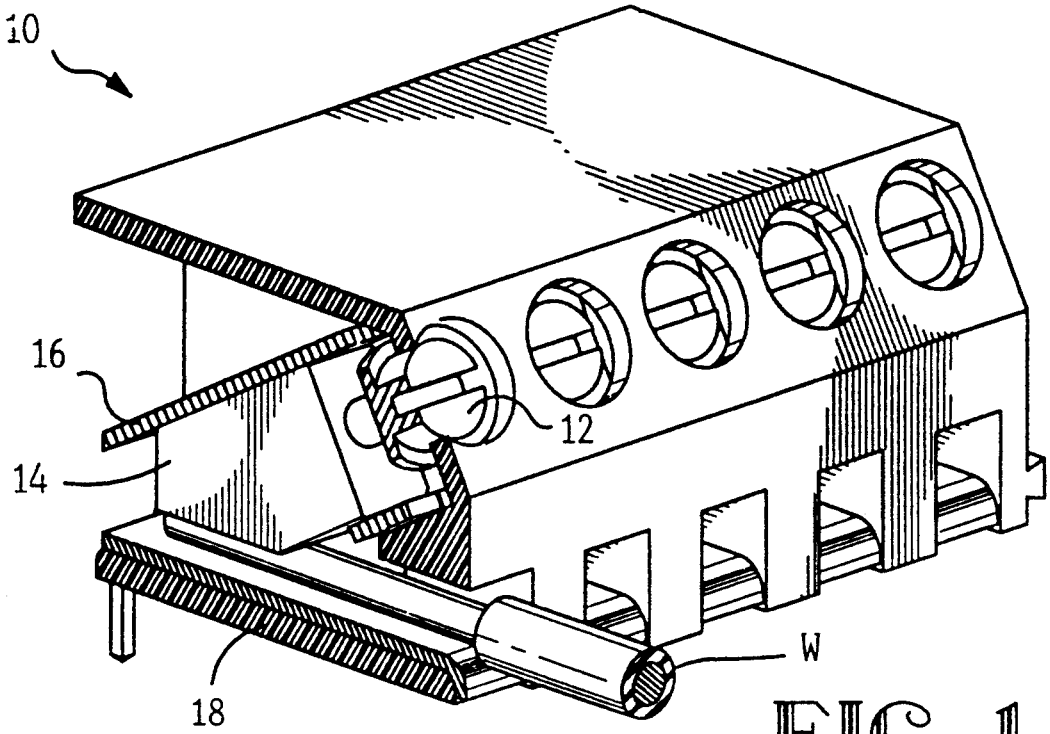
FIG. 1 is a perspective view in partial cutaway of an electrical connector which incorporates a first preferred embodiment of this invention, showing a wire clamped in position in the connector.
Figure 2:
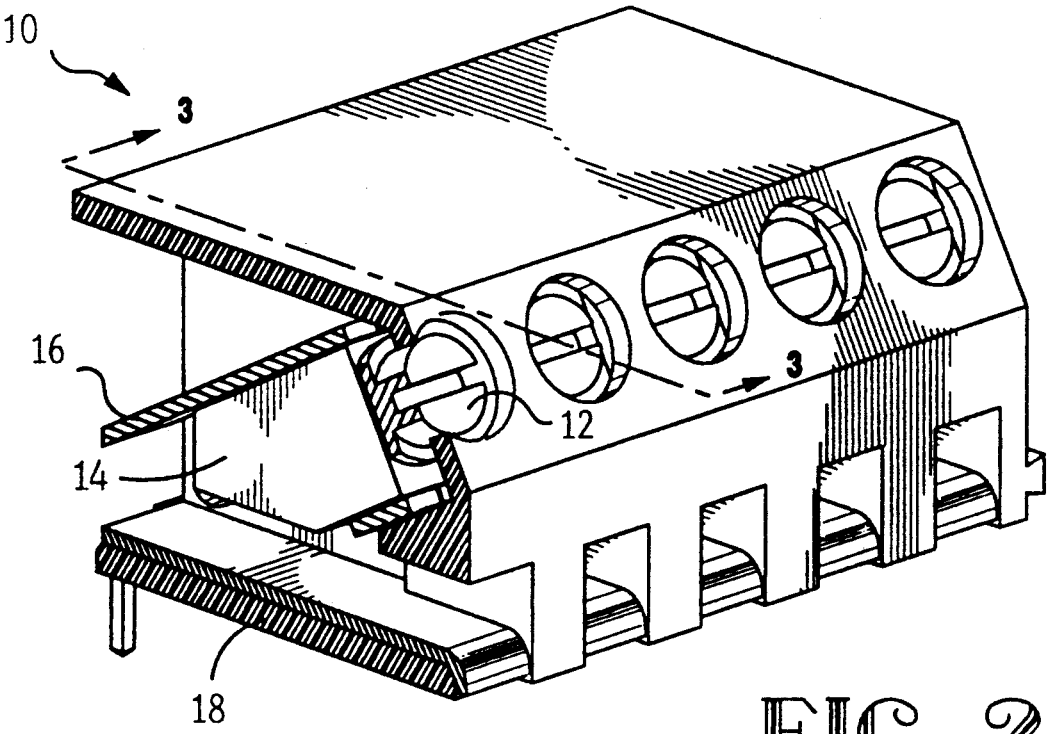
FIG. 2 is a view corresponding to that of FIG. 1 with the wire removed.

Turning now to the drawings, FIGS. 1 and 2 show perspective views in partial cutaway of an electrical connector 10. This connector 10 includes five identical subunits, one of which is shown in cutaway in FIGS. 1 and 2. The remaining subunits are identical, and therefore do not require separate discussion. Of course, the number of subunits can be varied as desired, and in the extreme case the connector can include only one.

Each of the subunits of the connector 10 includes a screw 12 which is threadedly received in a clamp 14, which is in turn slidably mounted in a cage 16. The screw 12, clamp 14 and cage 16 form a modular unit which is received in a bay of a housing 18. As shown in FIG. 1, the screw 12 can be rotated to push the clamp 14 into engagement with a wire W in order to secure the wire W in place in the connector 10. Alternately, the screw 12 can be rotated to position the clamp 14 as shown in FIG. 2 to allow a wire to be inserted into or removed from the connector 10.

Figure 3:
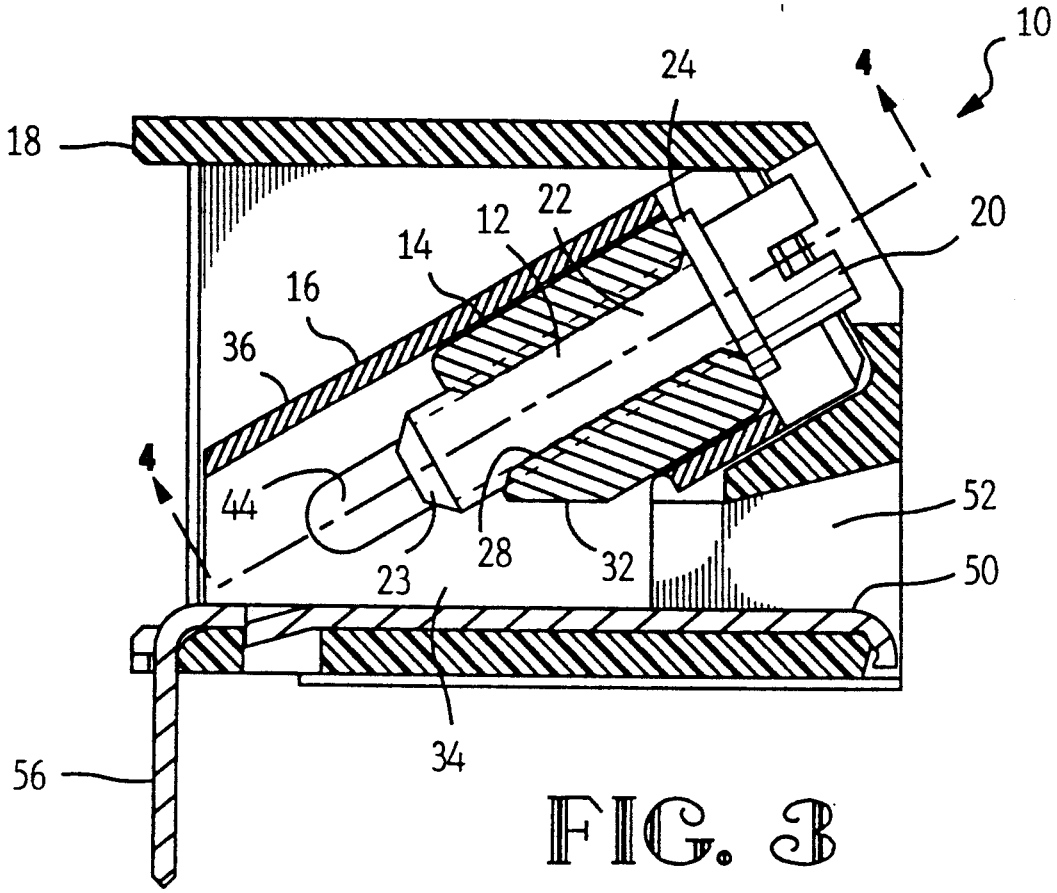
FIG. 3 is a cross-sectional view taken along line 3—3 of FIG. 2.
Figure 4:
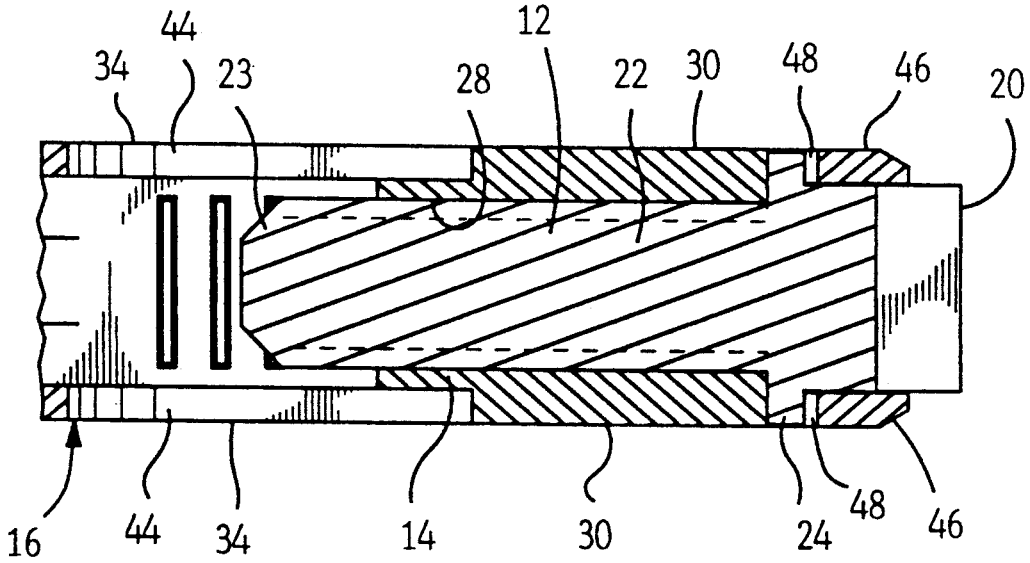
FIG. 4 is a cross-sectional view taken along line 4—4 of FIG. 3.

FIGS. 3 and 4 provide more detailed views of the screw 12, which includes a screw head 20 and a shaft 22. The shaft 22 is threaded and terminates in a free end 23. The screw head 20 defines an annular flange 24 of increased diameter as compared to the remainder of the screw head 20.

Also as shown in FIGS. 3 and 4, the clamp 14 defines a threaded bore 28 that receives the threaded shaft 22. The clamp 14 defines two elongated guide elements such as ribs 30 which extend parallel to the threaded bore 28. An exterior surface of the clamp 14 is shaped to engage the wire W, and this surface operates as a contact surface 32.

Figure 8:
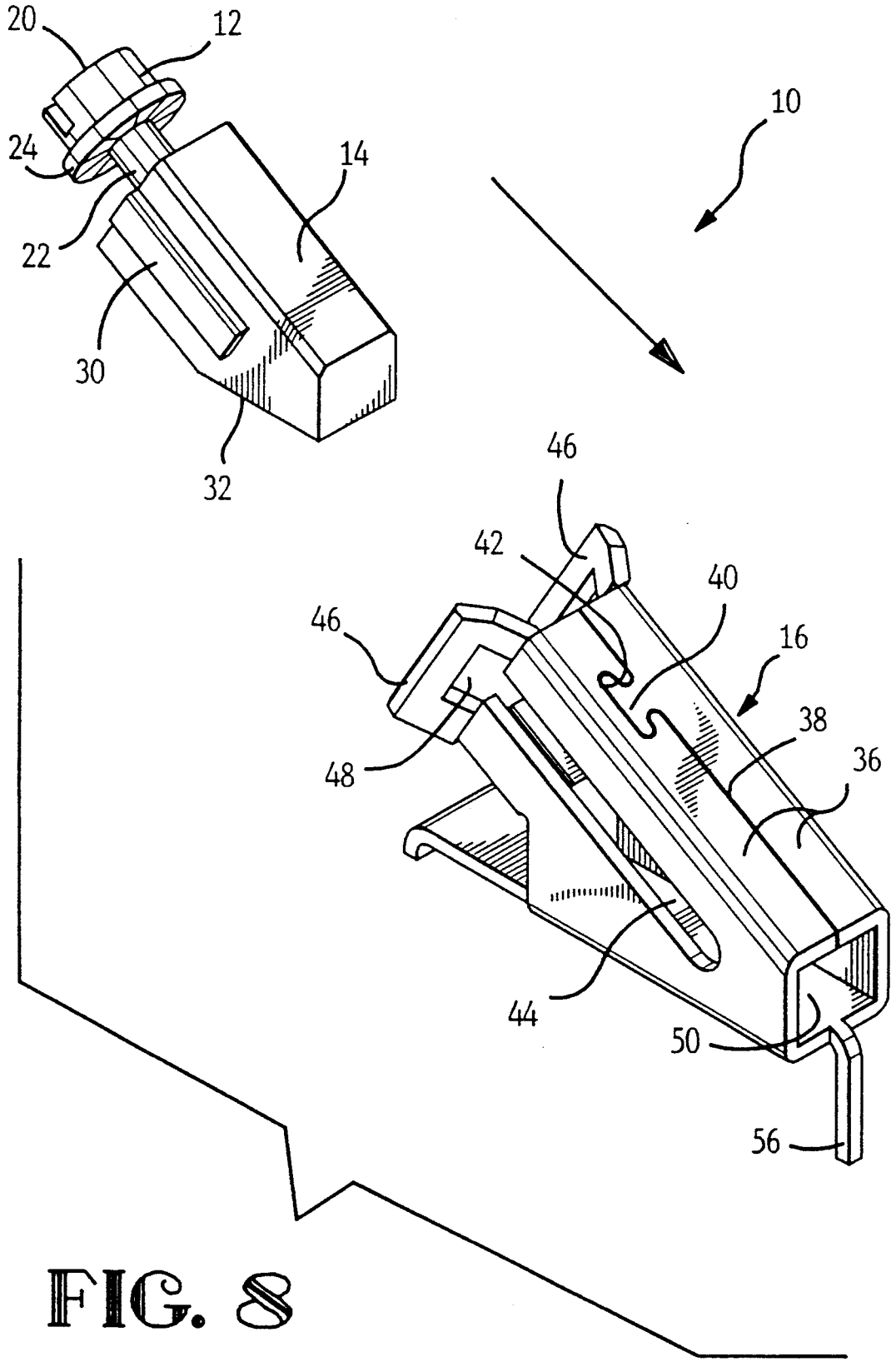
FIG. 8 is an exploded perspective view of the screw clamp and cage of the embodiment of FIGS. 1–4.

As best shown in FIGS. 3, 4 and 8, the cage 16 is a stamped and formed part which includes a pair of side walls 34 that are parallel to one another and that define between them a space sized to receive the clamp 14. The side walls 34 are each connected at their upper edge with a respective top wall 36, and the top walls 36 are generally coplanar and adjacent to one another. The top walls 36 meet at a seam 38 (FIG. 8), and respective ones of the top walls 36 define a protruding element 40 and a mating recess 42. The protruding element 40 is generally T-shaped in configuration, and the recess 42 defines a complementary T-shape. In general, the protruding element 40 and the recess 42 should have complementary shapes such that they form a mechanical interlock that prevents the top walls 36 from separating from one another in response to internal clamping pressures generated by the clamp 14 and the screw 12.

In general, the protruding element 40 and the recess 42 operate as a means for resisting separation of the top walls 36. Alternately, this function can be performed by securing the top walls 36 together in a secondary operation, such as a spot welding operation.

The side walls 34 of the cage 16 define respective elongated guide slots 44 sized and shaped to receive respective ribs 30 of the clamp 14. The outermost portions of the side walls 34 terminate in upstanding wings 46, and each of the wings 46 defines a respective transverse slot 48. The transverse slot 48 on each side wall 34 intersects the respective elongated guide slot 44 to form a T-shaped cutout. In FIG. 3 the oblique guide axis along which the clamp 14 moves is designated by the reference symbol 0, and the insertion axis along which the wire is inserted into and removed from the clamp 10 is designated by the symbol I.

Figure 6:
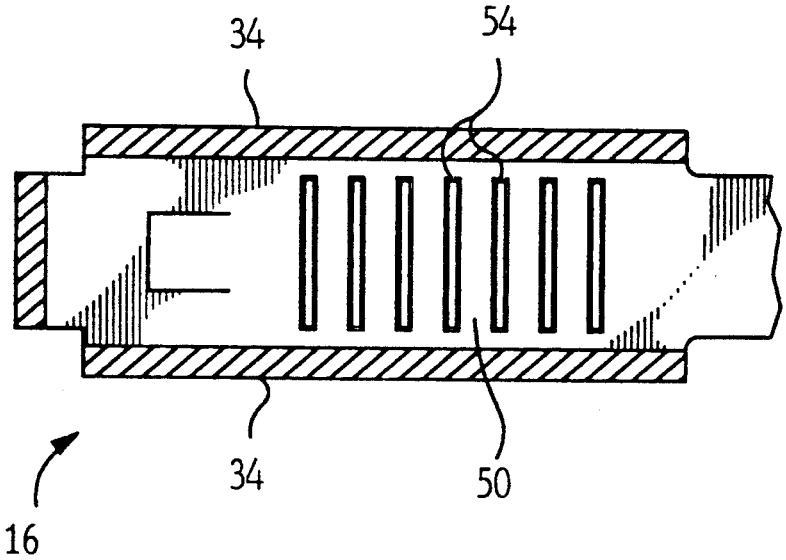
FIG. 6 is a cross-sectional view taken along line 6—6 of FIG. 5.

The portion of the cage 16 opposed to the top walls 36 forms a contact surface 50 positioned to contact the wire being clamped. This contact surface 50 forms one boundary of a wire receiving area 52, and the contact surface 50 is provided with an array of indents 54 (FIG. 6) adapted to improve electrical contact and frictional engagement between the cage 16 and the wire W. The cage 16 also defines a post 56 that can be used to establish electrical contact with the cage 16, and with the wire via the clamp 14 and the contact surface 50.

Figure 7:
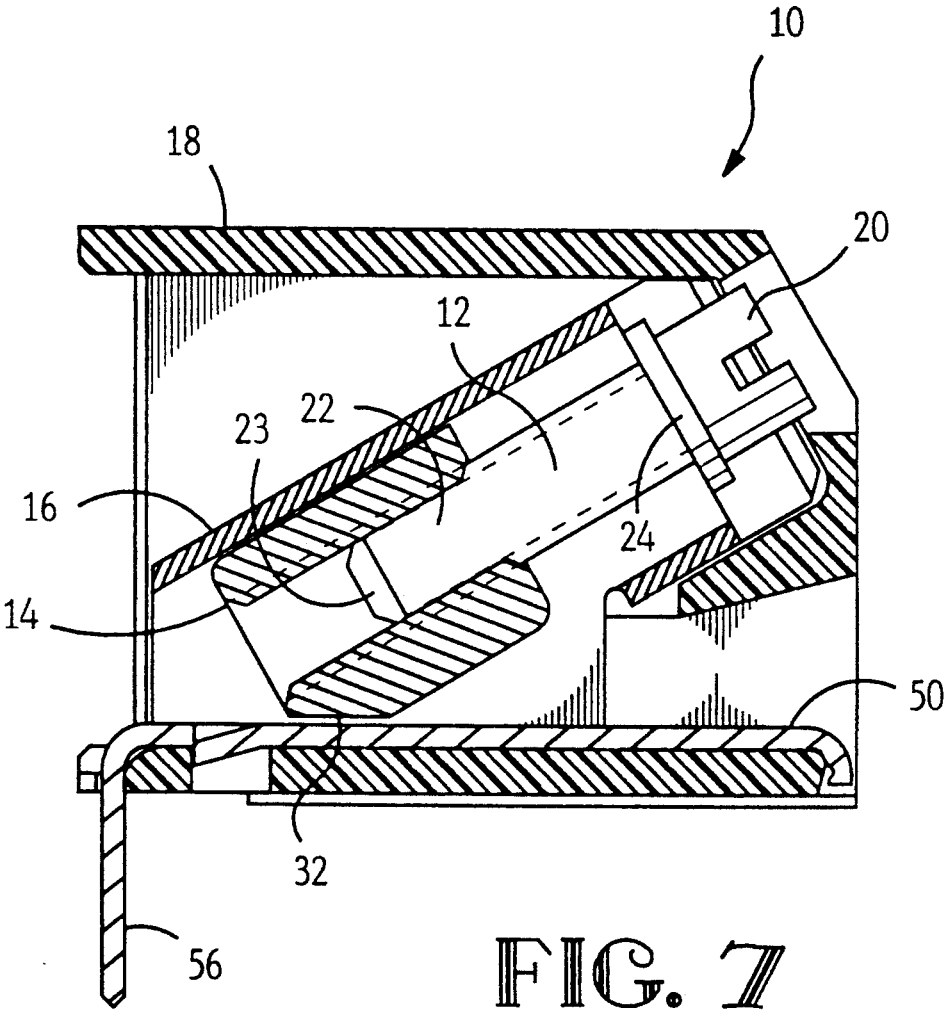
FIG. 7 is a view corresponding to FIG. 3 showing the clamping member positioned adjacent the contact surface of the cage.

The operation of the connector 10 is best shown by FIGS. 1, 2, 3 and 7. FIGS. 2 and 3 show the connector 10 with the clamp 14 moved out of the wire receiving area 52. In this position, the wire can be inserted into and removed from the connector 10. After the wire has been inserted, the screw 12 is rotated to move the clamp 14 downwardly, toward the contact surface 50 and against the wire (FIGS. 1 and 7). The flange 24 cooperates with the transverse slot 48 to prevent the screw 12 from moving outwardly. This allows the screw 12 to force the clamp 14 against the wire thereby providing a secure grip on the wire and reliable electrical contact with the wire. The ribs 30 cooperate with the guide slots 44 to guide the movement of the clamp 14 and to transfer clamping forces from the clamp 14 directly to the side walls 34.

Figure 5:
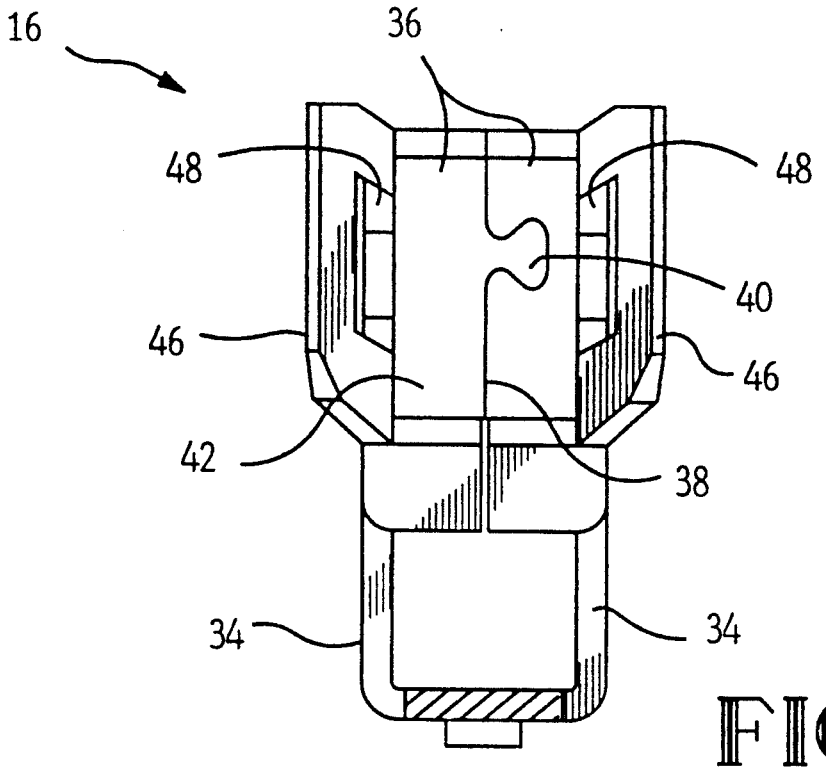
FIG. 5 is a front view of the cage of the embodiment of FIGS. 1–4 at an intermediate stage of fabrication.
Figure 9:
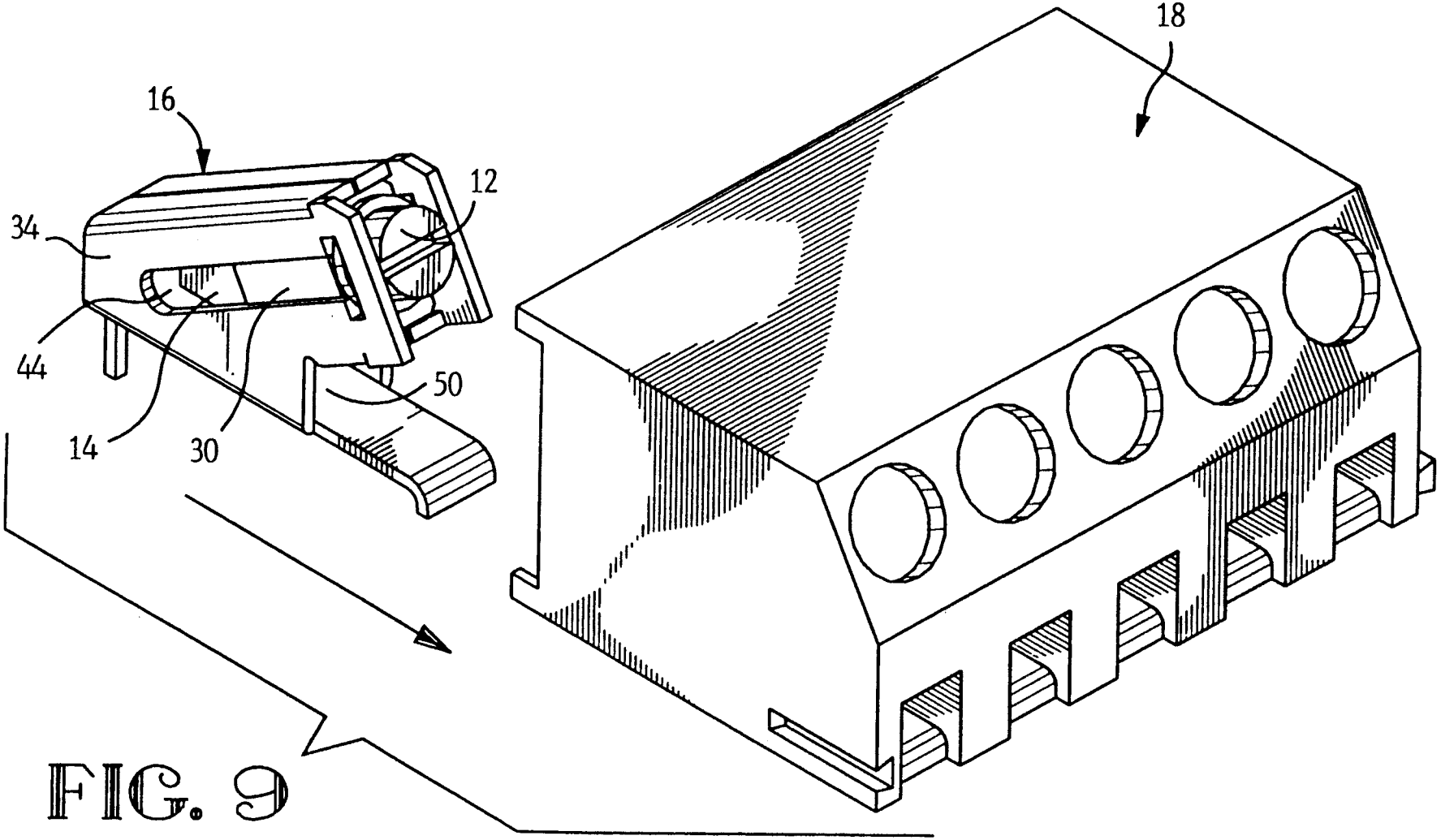
FIG. 9 is an exploded perspective view of the embodiment of FIGS 1–4.

FIGS. 5, 8 and 9 illustrate various stages in the assembly of the connector 10. As shown in FIG. 5, the cage 16 is initially formed with the wings 46 bent outwardly. As shown in FIG. 8, the screw 12 is threaded into the clamp 14, and this subassembly is then moved into the cage 16. The flared wings 46 allow the flange 24 to move into the area of the transverse slots 48 and the ribs 30 to move into the guide slots 44. Once the screw 12 and the clamp 14 are properly positioned in the cage 16, the wings 46 are bent back, parallel to the side walls 34, in order to capture the screw 12 and the clamp 14 in place in the cage 16.

As shown in FIG. 9, the subassembly of the cage 16, the clamp 14 and the screw 12 is then moved into the housing 18, and the contact surface 50 is bent downwardly over the housing 18 as shown in FIG. 1 to complete assembly.

Simply by way of example and in order to define the best mode of this invention, the following details of construction are provided. However, it should be clearly understood that these details are intended only by way of example, and not of limitation. In the connector 10 the clamp 14 is a die-cast element preferably formed of a conductive metal such as zinc. The cage 16 is preferably a stamped and formed element made of a conductive metal such as phosphor-bronze plated with tin. The housing 18 is preferably formed of an insulating synthetic material.

A number of features of the connector 10 should be emphasized. First, the clamp 14 is positively positioned by the side walls 34 such that it is free to move along the oblique axis 0 but it is prevented from rotating. This is a direct result of the fact that the ribs 30 define a length along the oblique axis 0 which is greater than their width transverse to the oblique axis 0.

Second, when large solid conductors are clamped in place in an off-center position, rotational forces are exerted on the clamp 14. If these rotational forces were not resisted properly there would be a tendency for the top walls 36 to separate from one another. This would be highly disadvantageous, because if the top walls 36 were to separate the screw 12 might escape from the transverse slots 48, thereby destroying the effectiveness of the connector 10. This undesirable separation is resisted by the mechanical interlock provided by the protruding element 40 and the recess 42.

The connector 10 has been designed to work with both solid and stranded wires over a wide range of gauges. For example, in one example the connector 10 can function with 12 gauge solid conductor wire having a diameter of 0.084 inch as well as with 24 gauge stranded conductor wire having individual strands having a diameter of approximately 0.007 inch. When a solid conductor 12 gauge wire is positioned to one side of the wire receiving area 52, large rotational forces can be applied to the clamp 14. These forces are effectively resisted by the structure described above.

Another important point is that the clamp 14 is configured such that when the clamp 14 is positioned against the contact surface 50 a considerable portion of the clamp 14 is cantilevered out beyond the free end 23 of the screw 12 (FIG. 7). This insures that when the clamp 14 is moved out of the wire receiving area 52, the free end 23 of the screw 12 does not interfere with full insertion of the wire into the wire receiving area 52. The clamp 10 has been found to operate reliably with a wide range of wire sizes, as discussed above.

In addition, the arrangement of the transverse slot 48 in the wings 46 allows the connector 10 to be assembled simply in the manner described above in conjunction with FIGS. 6 and 8. Because the elongated guide slots 44 intersect the respective transverse slots 48, both the clamp 14 and the screw 12 can be assembled from the top as shown in FIG. 8.

Of course, the connector 10 is merely one example of the invention, and the invention itself can be modified as appropriate for the intended application. For example, the post 56 is shown as oriented transverse to the insertion axis I. In alternate arrangements the post 56 can be oriented parallel or at an oblique angle to the axis I, and if desired it can be designed for a gripping receptacle connection, a solder connection or a wire wrap connection. Each of the separate improvements defined by the following independent claims can be used independently of the others, though the connector 10 employs all of these improvements in combination.

It is therefore intended that the scope of this invention be defined by the following claims, including all equivalents.

We claim:

1. An electrical connector comprising: an enclosed cage surrounding a wire engaging clamp, guide elements on the cage receiving complementary guide elements on the clamp, the guide elements on the cage extending to an open end of the cage into which the clamp is assembled, a screw rotatably mounted in the cage and threadably connected to the clamp for advancing the clamp to engage a wire in a wire receiving area of the cage, and bendable portions of the cage having transverse slots, the bendable portions being bendable to move the transverse slots closer together to receive rotatably therein a transverse flange on the screw.

2. An electrical connector as recited in claim 1, wherein the wire receiving area is between an end of the screw and a contact surface on the cage, and the transverse slots restrain the screw from movement of the end of the screw into the wire receiving area.

3. An electrical connector as recited in claim 1, wherein the guide elements on the cage intersect respective said transverse slots to enable assembly of both the screw and the clamp into the open end of the cage.

4. An electrical connector as recited in claim 1, wherein a seam bifurcates a circumference of the cage, and the circumference interlocks at the seam.

5. An electrical connector as recited in claim 1, wherein the bendable portions are flared wings, the wings being bendable to move the slots closer together.

6. An electrical connector as recited in claim 1, and further comprising: a housing receiving the cage, a wire receiving area being open at one side of the housing, and the open end of the cage being open at another side of the housing.

7. An electrical connector as recited in claim 1, wherein the clamp is encircled by walls of the cage, and the clamp is received by the cage solely through the open end of the cage.

8. An electrical connector as recited in claim 2, wherein the guide elements on the cage are guide slots, and the complementary guide elements on the clamp are ribs received slidingly in the guide slots.

9. An electrical connector as recited in claim 8, wherein the guide slots on the cage intersect respective said transverse slots to enable assembly of both the screw and the clamp into the open end of the cage.

* * * * *